US011199323B2

(12) United States Patent
Saito et al.

(10) Patent No.: US 11,199,323 B2
(45) Date of Patent: Dec. 14, 2021

(54) BURNER

(71) Applicant: TAIYO NIPPON SANSO CORPORATION, Tokyo (JP)

(72) Inventors: Takeshi Saito, Kai (JP); Yoshiyuki Hagihara, Kofu (JP); Yasuyuki Yamamoto, Kofu (JP); Naoki Seino, Kai (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 227 days.

(21) Appl. No.: 16/330,457

(22) PCT Filed: May 19, 2017

(86) PCT No.: PCT/JP2017/018788
§ 371 (c)(1),
(2) Date: Mar. 5, 2019

(87) PCT Pub. No.: WO2018/051576
PCT Pub. Date: Mar. 22, 2018

(65) Prior Publication Data

US 2020/0088404 A1 Mar. 19, 2020

(30) Foreign Application Priority Data

Sep. 16, 2016 (JP) ..... JP2016-181092

(51) Int. Cl.
*F23D 14/84* (2006.01)
*F23D 14/56* (2006.01)
(Continued)

(52) U.S. Cl.
CPC ..... *F23D 14/84* (2013.01); *F23D 14/56* (2013.01); *F23D 14/32* (2013.01)

(58) Field of Classification Search
CPC ..... F23D 14/22; F23D 14/32; F23D 14/56; F23D 14/84; F23D 2900/14482
See application file for complete search history.

(56) References Cited

U.S. PATENT DOCUMENTS 5,110,285 A * 5/1992 Snyder ..... F23D 14/22 431/8
5,601,425 A 2/1997 Kobayashi et al.
(Continued)

FOREIGN PATENT DOCUMENTS

CN 102721056 10/2012
CN 102884207 1/2013
(Continued)

OTHER PUBLICATIONS

International Search Report for PCT/JP2017/018788, dated Aug. 1, 2017, 4 pages.
(Continued)

*Primary Examiner* — Jorge A Pereiro
*Assistant Examiner* — Logan P Jones
(74) *Attorney, Agent, or Firm* — Nixon & Vanderhye P.C.

(57) ABSTRACT

One object of the present invention is to provide a burner which can uniformly heat a wide area without decreasing the heat radiation even when the swing width of the flame self-oscillating is large, and the present invention provides a burner in which a main combustion fluid and a second combustion fluid are combusted by ejecting the main combustion fluid while self-oscillating from a central expanding ejection port (3) which expands towards a tip end and ejecting the second combustion fluid from a pair of side ejection ports (5 and 7) provided on both sides of the central expanding ejection port (3), wherein a pair of the side ejection ports (5 and 7) are disposed symmetrically with respect to a central axis of the central expanding ejection port (3), and the central expanding ejection port (3) and the
(Continued)

side ejection ports (5 and 7) are provided such that an expanding angle α of the central expanding ejection port (3) and an angle β formed by the central axes of a pair of the side ejection ports (5 and 7) satisfy a relationship of $-5° \leq \beta \leq \alpha + 15°$.

1 Claim, 8 Drawing Sheets

(51) Int. Cl.
*F23D 14/32* (2006.01)
*F23D 14/22* (2006.01)

(56) References Cited

U.S. PATENT DOCUMENTS

| | | | | |
|---|---|---|---|---|
| 5,681,526 | A | 10/1997 | Zhang | |
| 6,343,927 | B1 | 2/2002 | Eroglu et al. | |
| 2013/0309617 | A1* | 11/2013 | Haneji | F23C 7/02 431/12 |

FOREIGN PATENT DOCUMENTS

| | | |
|---|---|---|
| CN | 203565235 | 4/2014 |
| JP | 04-273904 | 9/1992 |
| JP | 2001-059602 | 3/2001 |
| JP | 2005-113200 | 4/2005 |
| JP | 3970139 | 9/2007 |
| JP | 2013-079753 | 5/2013 |
| JP | 2014-505851 | 3/2014 |
| WO | 2012/092069 | 7/2012 |

OTHER PUBLICATIONS

Office Action issued in TW Appln. No. 106116280 dated Apr. 8, 2020 (w/ partial translation).
Office Action issued in CN Appln. No. 201780053801.6 dated Sep. 3, 2019 (w/ translation).

* cited by examiner

BURNER

TECHNICAL FIELD

The present invention relates to a burner, in particular, a burner which heats and melts an object to be heated by heat radiant of flame.

This application is the U.S. national phase of International Application No. PCT/JP2017/018788 filed 19 May 2017 which designated the U.S. and claims priority to Japanese Patent Application No. 2016-181092, filed Sep. 16, 2016, the entire contents of each of which are incorporated herein by reference.

BACKGROUND ART

In general, an industrial high-temperature heating process such as a heating furnace for steel and a melting furnace for glass has a structure in which an object to be heated such as billet or molten glass is placed in a lower part of the furnace, a flame is created in an upper part, and the object to be heated is heated or molten by heat radiation from the flame.

Accordingly, the flame of a burner is required to have strong heat radiation and uniformly heat the object to be heated.

As a method of making a flame having strong heat radiation, Patent Documents 1 and 2 disclose a technique of using a self-oscillating phenomenon of jet flow to oscillate (periodically increasing or decreasing the flow rate) a gas ejected from a fluid ejection port, and a flame is widely supplied to increase the heat radiation and uniformly heat.

According to the method disclosed in Patent Document 1, it is possible to heat a wider area than that of the normal burner by swinging the flame in the right and left using the self-oscillating phenomenon.

In addition, according to the method described in Patent Document 2, it is possible to heat further wider area than that of the method disclosed in Patent Document 1 by further providing second gas jet flows around a fluid ejection port causing self-oscillating.

PRIOR ART DOCUMENTS

Patent Literature

Patent Document 1 Japanese Unexamined Patent Application, First Publication No. 2005-113200

Patent Document 2 Japanese Unexamined Patent Application, First Publication No. 2013-079753

SUMMARY OF INVENTION

Problem to be Solved by the Invention

However, according to the method described in Patent Document 2, there is no regulation on the relationship between the direction of the fluid ejection port causing the self-oscillating and the direction of the ejection port of the second gas jet flow, and when the swing width of the flame self-oscillating becomes large, the combustion becomes slow and the flame temperature becomes low, so there was a problem that the heal radiation becomes weak.

The present invention has been made to solve the above problems, and it is an object of the present invention to provide a burner which can uniformly heat a wide area without decreasing the heat radiation even when the swing width of the flame self-oscillating is large.

Means for Solving the Problem (1) A burner in which a main combustion fluid and a second combustion fluid are combusted by ejecting the main combustion fluid while self-oscillating from a central expanding ejection port which expands towards a tip end and ejecting the second combustion fluid from a pair of side ejection ports provided on both sides of the central expanding ejection port, wherein a pair of the side ejection ports are disposed symmetrically with respect to a central axis of the central expanding ejection port, and the central expanding ejection port and the side ejection ports are provided such that an expanding angle $\alpha$ of the central expanding ejection port and an angle $\beta$ formed by the central axes of a pair of the side ejection ports satisfy a relationship of $-5° \leq \beta \leq \alpha+15°$.

(2) A burner in which a main combustion fluid and a second combustion fluid are combusted by ejecting the main combustion fluid while self-oscillating from a central expanding ejection port which expands towards a tip end and ejecting the second combustion fluid while self-oscillating from a pair of side ejection ports provided on both sides of the central expanding ejection port, wherein a pair of the side ejection ports are disposed symmetrically with respect to a central axis of the central expanding ejection port, and the central expanding ejection port and the side ejection ports are provided such that an expanding angle $\alpha$ of the central expanding ejection port and an angle $\beta$in formed by inner side walls of the pair of side expanding ejection ports satisfy a relationship of $-5° \leq \beta$in, and an angle $\beta$out formed by outer side walls of the pair of side expanding ejection ports and the expanding angle $\alpha$ satisfy a relationship of $\beta$out$\leq\alpha+15°$.

Effects of the Invention

A burner according to the present invention is a burner in which a main combustion fluid and a second combustion fluid are combusted by ejecting the main combustion fluid while self-oscillating from a central expanding ejection port which expands towards a tip end and ejecting the second combustion fluid from a pair of side ejection ports provided on both sides of the central expanding ejection port, wherein a pair of the side ejection ports are disposed symmetrically with respect to a central axis of the central expanding ejection port, and the central expanding ejection port and the side ejection ports are provided such that an expanding angle $\alpha$ of the central expanding ejection port and an angle $\beta$ formed by the central axes of a pair of the side ejection ports satisfy a relationship of $-5° \leq \beta \leq \alpha+15°$. Accordingly, even when the swing width of the flame self-oscillating is large, it is possible to mix the main combustion fluid and the second combustion fluid well, increase the combustion efficiency, and increase the heat radiation while forming a flame in a wide area.

BRIEF DESCRIPTION OF DRAWINGS

FIG. 3(*a*) shows a state in which the main fuel fluid flows along one expanding side wall of the central expanding ejection port. FIG. 3(*b*) shows a state in which the main fuel fluid flows along the other expanding side wall of the central expanding ejection port.

FIG. 4(*a*) shows a state in which the flame is formed on the left side of the central expanding ejection port (on the expanding side wall 3*b* side). FIG. 4(*b*) shows a state in which the flame is formed in the vicinity of the central portion of the central expanding ejection port. FIG. 4(*c*) shows a state in which the flame is formed on the right side of the central expanding ejection port (on the expanding side wall 3*a* side).

FIG. 11 (*a*) shows a state in which the flame is formed on the left side of the central expanding ejection port (on side ejection ports 7 side). FIG. 11 (*b*) shows a state in which the flame is formed in the vicinity of the central portion of the central expanding ejection port. FIG. 11 (*c*) shows a state in which the flame is formed on the right side of the central expanding ejection port (on side ejection ports 5 side).

DETAILED DESCRIPTION OF THE PREFERRED EMBODIMENTS

After describing combustion fluids in the present invention, the configuration of a burner in each embodiment will be described in detail with reference to FIGS. 1 to 3. In figures used in the following description, for the sake of easy understanding of the features, there are cases in which characteristic portions are shown enlarged for convenience, and it is not always that the dimensional ratio of each component is the same as the actual.

<Combustion Fluid>

In the present invention, the combustion fluid is a fuel fluid, a combustion-assisting fluid, or a mixed fluid of a fuel fluid and a combustion-assisting fluid. As a combination of a main combustion fluid and a second combustion fluid, both a combustion-assisting fluid are excluded, and either the main combustion fluid or the second combustion fluid is the fuel fluid or the mixed fluid.

First Embodiment

Figure 1:
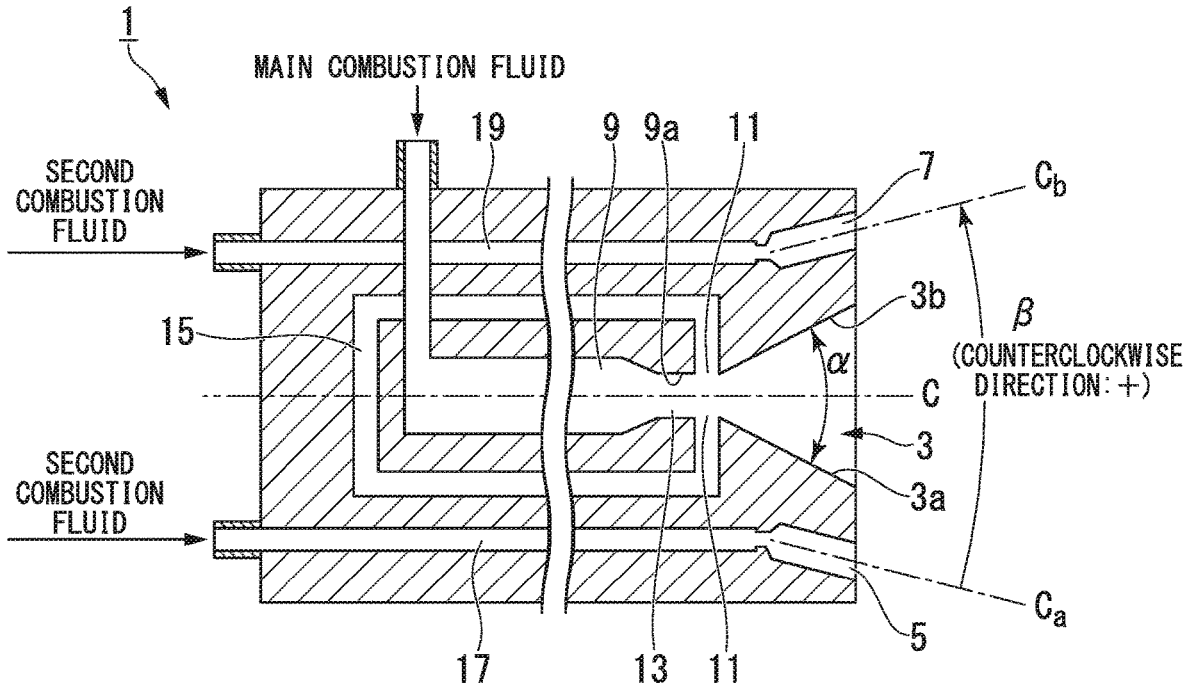
FIG. 1 is a plane sectional view for explaining a burner according to a first embodiment.

As shown in FIG. 1, a burner 1 according to the present embodiment ejects and combusts a main combustion fluid while self-oscillating from a central expanding ejection port 3 which expands toward a tip end, and also ejects and combusts a second combustion fluid from side election ports 5 and 7 which are provided on both sides of the central expanding ejection port 3.

<Central Expanding Ejection Port>

Figure 2:
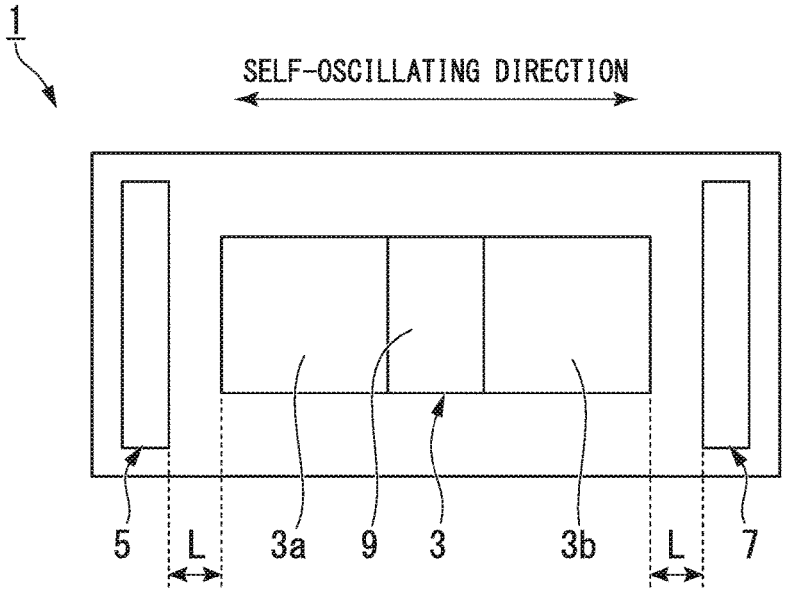
FIG. 2 is a view for explaining a burner according to the first embodiment, and showing a state in which a central expanding ejection port and side ejection ports are viewed from the front.

The central expanding ejection port 3 ejects the main combustion fluid, is provided at the tip end of the main combustion fluid supply passage 9 for supplying the main combustion fluid, and has a rectangular cross section which is orthogonal to a flow direction of the main combustion fluid as shown in FIGS. 1 and 2.

A rectangular cylindrical straight body portion 13 is provided in the main combustion fluid supply flow passage 9 on the upstream side of the duct opening portion 11 and a central expanding ejection port 3 is provided in the main combustion fluid supply flow passage 9 on the downstream side of the duct opening portion 11.

As explained above, the cross section of the central expanding ejection port 3, which is orthogonal to the flow direction of the main combustion fluid, has a rectangular shape. More specifically, the shape of the central expanding ejection port 3 in the plane cross section of the burner 1 is a fan shape expanded toward the tip end, and can be expressed by an expanding angle $\alpha$ formed by the expanding walls 3*a* and 3*b*, which are the side walls of the main combustion fluid supply passage 9 on the downstream side of the duct opening portion 11. In other words, the shape of the central expanding ejection port 3 in the flat cross-sectional view of the burner 1 is a fan shape, and the expanding angle formed by one expanding wall 3*a* the other expanding wall 3*b* which are the two radii of the fan shape is $\alpha°$.

The duct opening portions 11 and 11 communicate with each other through a communication duct 15 provided on the rear side of the burner 1. In this manner, it is possible to generate self-oscillating, so-called flip-flop nozzle jet flow in the main combustion fluid ejected from the central expanding ejection port 3 as shown in FIG. 3 by providing a pair of the duct opening portions 11 and 11 communicating with each other through a communication duct 15 in the main combustion fluid supply passage 9 of the burner 1 such that the pair of the duct opening portions 11 and 11 face each other.

Figure 3:
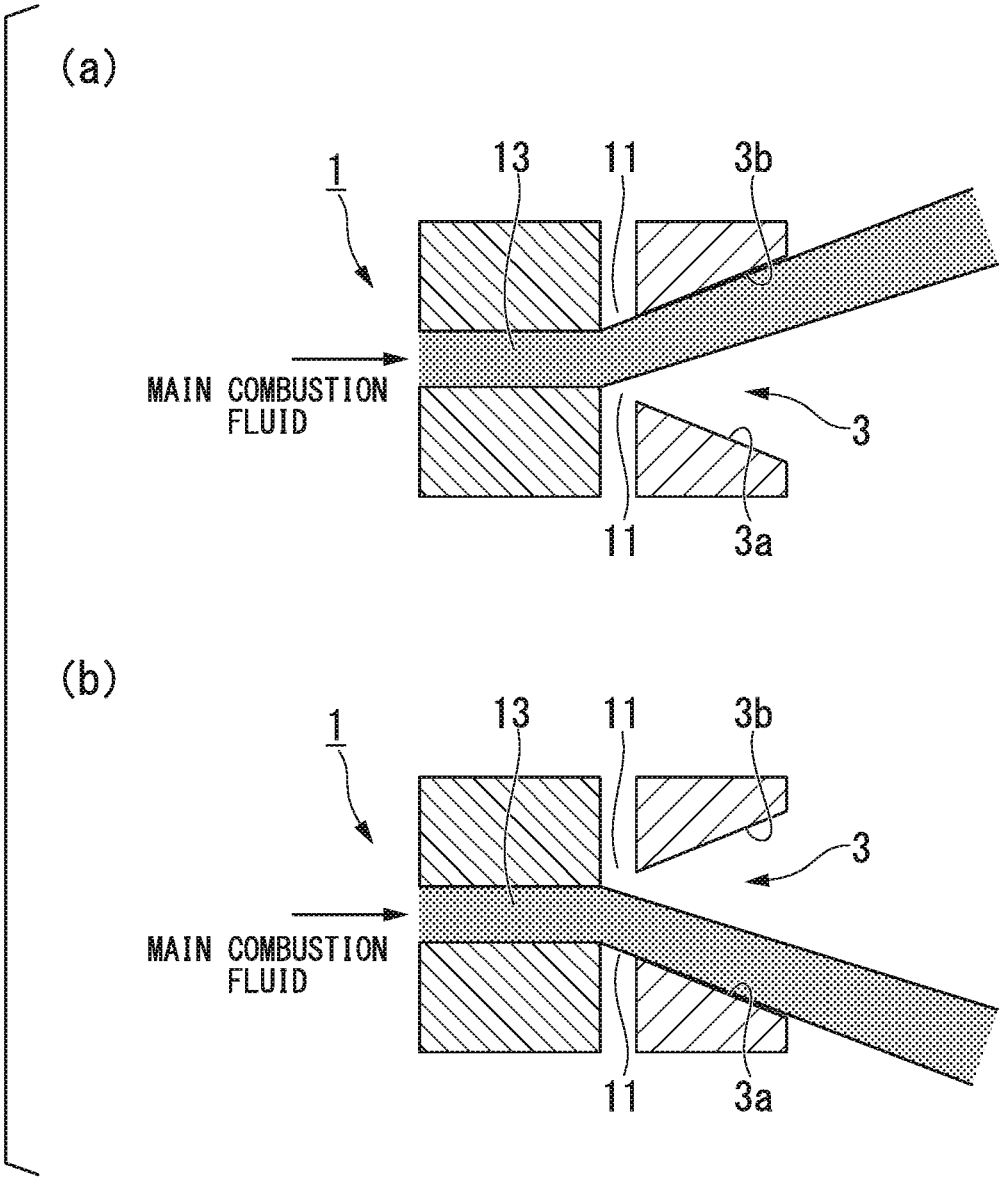
FIG. 3 is a view showing a main combustion fluid ejected from a central expanding ejection port in a burner according to the first embodiment.

That is, the main combustion fluid flowing into the straight body portion 13 flows out along one expanding wall 3*a* (see FIG. 3(*b*)) and the other expanding wall 3*b* (see FIG. 3(*a*)) alternately repeating, and self-oscillates (swinging in the right and left) when flowing to the central expanding ejection port 3.

The oscillation amplitude (swing width of the main combustion fluid ejected) and oscillation frequency (cycles per minute) of the self-oscillating can be adjusted by controlling various conditions, such as the dimensions of the central expanding ejection port 3, the duct opening portion 11, the straight body portion 13 and the communication duct 15, and flow rate of the main combustion fluid etc.

In addition, since the oscillation frequency of the self-oscillating fluctuates depending on the communication state of the duct opening portion 11, it is also possible to adjust by providing a control valve in the communication duct 15 and adjusting the gas flow rate and pressure.

<Side Ejection Ports>

As shown in FIG. 1, the side ejection ports 5 and 7 eject a second combustion fluid and are provided at the tip end of the second combustion fluid supply passages 17 and 19 supplying the second combustion fluid. The side ejection ports 5 and 7 are symmetrically arranged with respect to the central axis C of the central expanding ejection port 3.

Then, when the expanding angle of the central expanding ejection port 3 is α, and an angle formed by the central axis Ca of the side ejection port 5 and the central axis Cb of the side ejection port 7 is β, α and β are set so as to satisfy $-5° \leq \beta \leq \alpha+15°$. The angle β is set to be positive in the counterclockwise direction (the direction indicated by the arrow in FIG. 1) with respect to the central axis Ca of the side ejection ports 5, and to be negative in the clockwise direction. When the central axis Ca of the side ejection ports 5 intersects the central axis Cb of the side ejection ports 7, the angle β is represented by an angle measured in the clockwise direction, that is, a negative angle.

The behavior of the flame self-oscillating by the burner 1 according to this embodiment will be described with reference to FIG. 4.

In the present embodiment, a fuel fluid is supplied as the main combustion fluid and a combustion-assisting fluid is supplied as the second combustion fluid. The fuel fluid ejected from the straight body portion 13 of the supply flow passage 9 self-oscillates (swings in the right and left) by flowing alternately along the expanding walls 3*a* and 3*b* on both sides of the central expanding ejection port 3 when ejecting to the central expanding ejection port 3.

Figure 4:
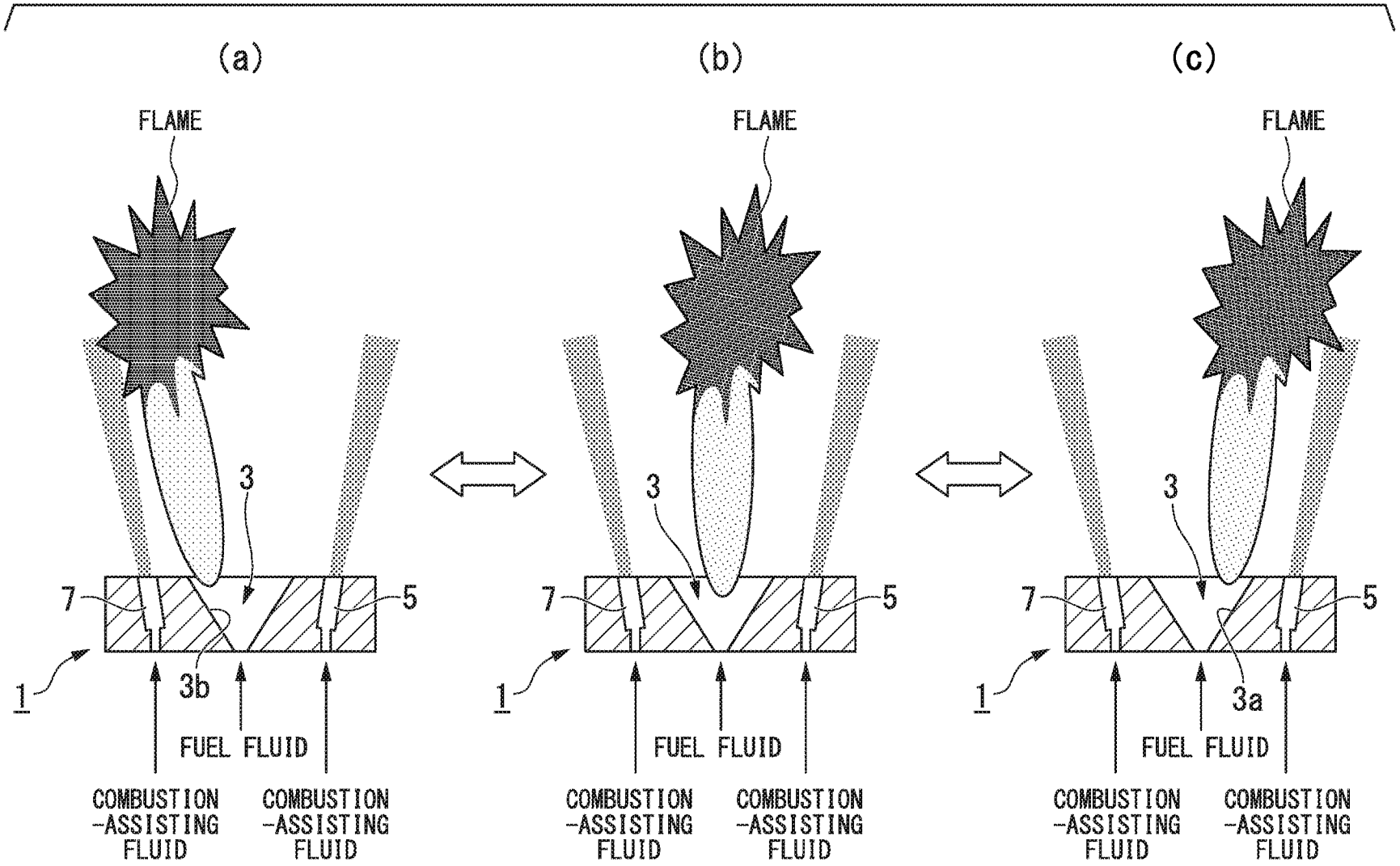
FIG. 4 is a view for explaining behavior of a flame self-oscillating in the burner according to the first embodiment.

Then, when the fuel fluid is ejected along the expanding wall 3*b*, the fuel fluid is mixed with the combustion-assisting fluid ejected from the side ejection port 7 located on the left side of the central expanding ejection port 3, and a flame is formed on the left side of the central expanding ejection port 3 (FIG. 4(*a*)). On the other hand, when the fuel fluid is ejected along the expanding wall 3*a*, the fuel fluid is mixed with the combustion-assisting fluid ejected from side ejection port 5 located on the right side of the central expanding ejection port 3, and a flame is formed on the right side of the central expanding ejection port 3 (FIG. 4(*c*)).

In the burner 1 of the present embodiment, as described above, the expanding angle α of the central expanding ejection port 3 and the angle β formed by the central axes Ca and Cb satisfy $-5° \leq \beta \leq \alpha+15°$, and the combustion-assisting fluid from the side ejection ports 5 and 7 is ejected in the direction of central axes Ca and Cb respectively.

By setting the shape and the positional relationship of the side ejection ports 5 and 7 and the central expanding ejection port 3 so as to satisfy $\beta \leq \alpha+15°$, even if the swing width increases by the self-oscillating of the flame, since the fuel fluid ejected from the expanding ejection port 3 can be mixed with the combustion-assisting fluid ejected from either the side ejection port 5 or 7 and combusted, it is possible to form the flame in a wide area while improving the combustion efficiency, and increase the heat radiation.

On the other hand, when the angle 1 is set to the lower limit or more ($-5° \leq \beta$), the swing width of the fuel fluid self-oscillating ejected from the central expanding ejection port 3 is not limited by the second combustion fluid ejected from the side ejection ports 5 and 7. Accordingly, it is possible to maintain a wide area of heat radiation from the flame.

The upper limit value (~+15°) and the lower limit value (−5°) of the angle β will be demonstrated in Examples to be described later.

Further, an offset distance L (see FIG. 2) between the central expanding ejection port 3 and the side ejection ports 5 (or 7) is set to about 30 mm in the burner 1 according to the first embodiment, but limited thereto. The offset distance L can be changed as appropriate.

The combustion efficiency of the burner 1 can be adjusted by changing the angle β and the offset distance L between the central expanding ejection port 3 and side ejection ports 5 (or 7).

As shown in FIG. 2, the side ejection ports 5 and 7 have rectangular planes perpendicular to the fluid flow direction, but the shapes are not limited to this shape, and may be cylindrical, multi-hole, etc. according to the desired flow amount and flow rate.

Figure 5:
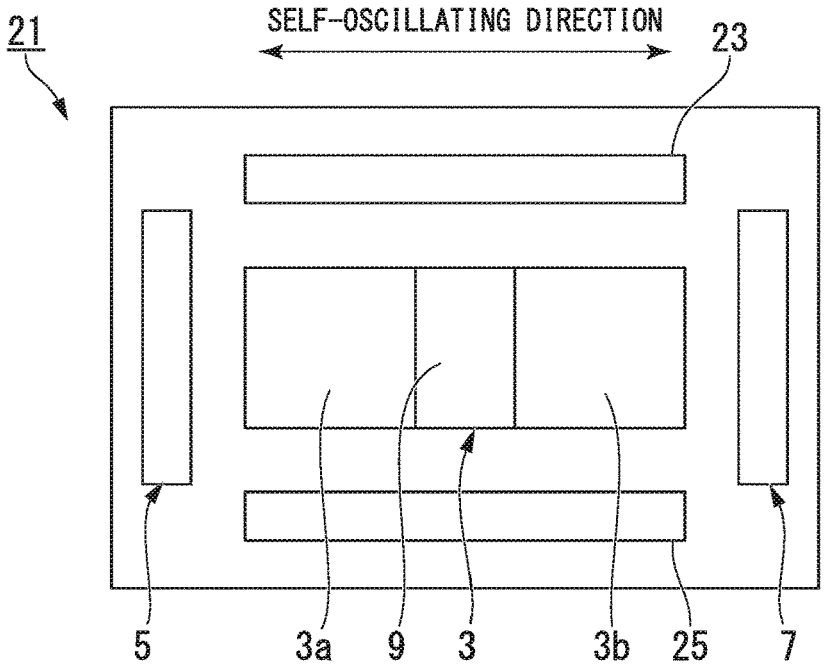
FIG. 5 is a view for explaining a burner of a modified first embodiment, and showing a state in which a central expanding ejection port and the side ejection ports are viewed from the front.

In addition, as shown in FIG. 5, a burner 21 including second ejection ports 23 and 25 provided above and below the central expanding ejection port 3 in addition to the side ejection ports 5 and 7 provided on both sides of the central expanding ejection port 3 are exemplary examples of a modified embodiment of the present embodiment.

The side ejection ports 5 and 7 and the second ejection ports 23 and 25 can be supplied with second combustion fluid separately. It is possible to supply the desired combustion fluid (fuel fluid, combustion-assisting fluid, and mixed fluid) by separately adjusting the flow amount.

At this time, the direction in which the second combustion fluid is ejected from the second ejection ports 23 and 25 (the angle formed by the central axes of the second ejection ports 23 and 25) is not particularly limited.

The effects of providing the second ejecting ports 23 and 25 will be described in an embodiment to be described later.

Second Embodiment

A burner 31 according to the second embodiment of the present invention will be described with reference to FIG. 6. The same constituent elements as those described in the above first embodiment are denoted by the same reference numerals, and descriptions of the components are omitted.

Figure 6:
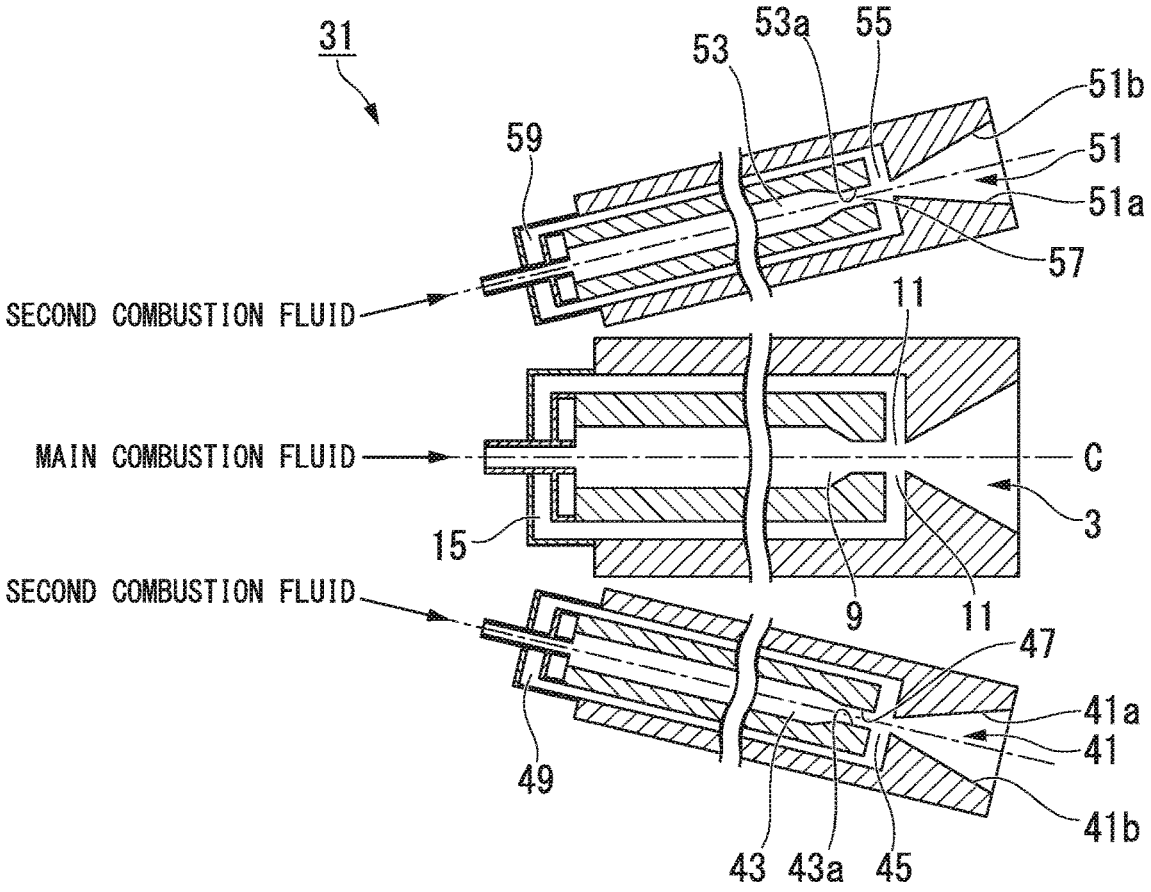
FIG. 6 is a view for explaining a burner according to a second embodiment (part 1).

The burner 31 shown in FIG. 6 includes the central expanding ejection port 3 expanding toward the tip end and a pair of side expanding ejection ports 41 and 51 which are provided on both sides of the central expanding ejection port 3 and expands in the ejection direction. While self-oscillating, the main combustion fluid is ejected from the central expanding ejection port 3 and the second combustion fluid is ejected from the side expanding ejection ports 41 and 51 and the main combustion fluid and the second combustion fluid are combusted.

Hereinafter, the burner 31 will be described in detail based on FIG. 6.

<Side Expanding Ejection Ports>

The side expanding ejection ports 41 and 51 eject the second combustion fluid and are separately provided at the tip end of second combustion fluid supply passages 43 and 53 supplying the second combustion fluid as shown in FIG. 6.

One side expanding ejection port 41 has an inner wall 41*a* near the central expanding ejection port 3 and an outer wall 41*b* far from the central expanding ejection port 3. The other side expanding ejecting port 51 has an inner wall 51*a* near the central expanding ejection port 3 and an outer wall 51*b* far from the central expanding ejection port 3.

Since the side expanding ejection port 41 and the side expanding ejection port 51 differ only in the direction of the central axes (the direction in which the second combustion fluid is ejected), the structures and functions of both are the same, and only the side expansion ejection opening 41 will be described except for the case where it is necessary.

A pair of duct opening portions 45 and 45 are provided at positions facing each other on the side wall 43*a* in the middle of the second combustion fluid supply passage 43.

A rectangular tubular straight body portion 47 is provided in the second combustion fluid supply passage 43 on the upstream side of the duct opening portions 45 and 45, and an expanding ejection port 41 is provided in the second combustion fluid supply passage 43 on the downstream side of the duct opening portions 45 and 45.

The duct opening portions 45 and 45 communicate with each other through a communication duct 49 provided on the rear side in the burner 31. In this manner, it is possible to generate self-oscillating in the second combustion fluid which is ejected from the side expanding ejection port 41 by providing a pair of the duct opening portions 45 and 45 communicating with each other through the communication duct 49 in the second combustion fluid supply passage 43.

Figure 7:
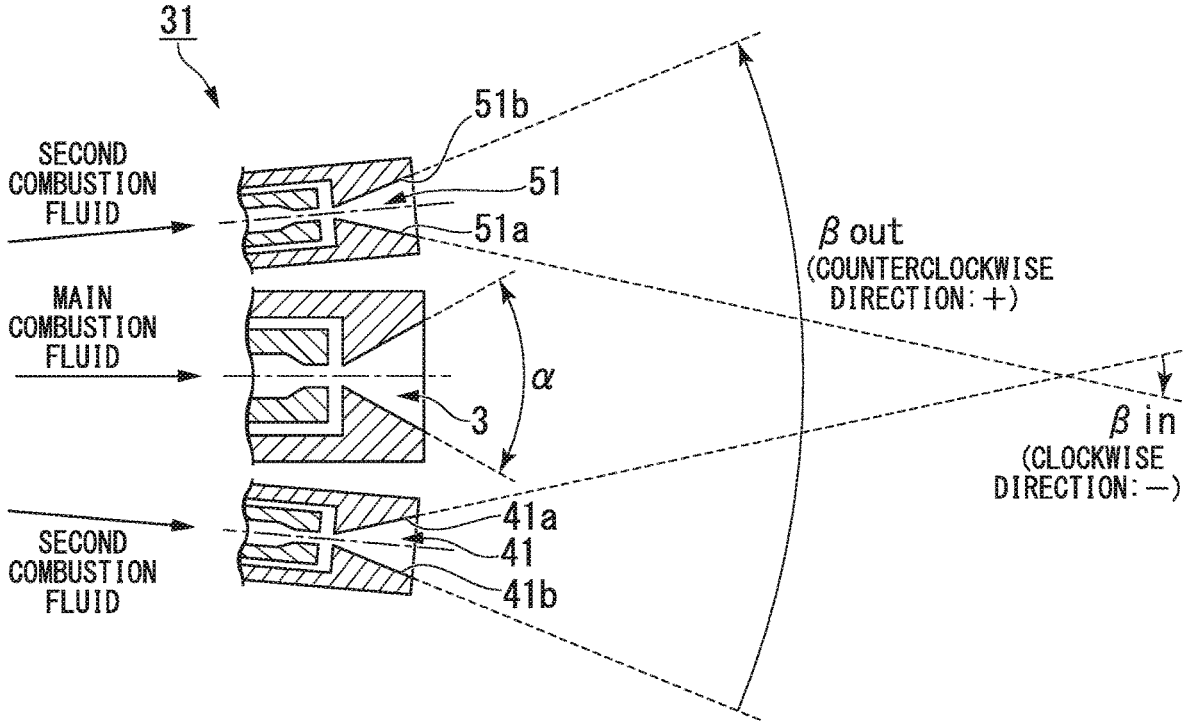
FIG. 7 is a view for explaining a burner according to a second embodiment (part 2).

As shown in FIG. 7, an angle βin formed by inner side walls 41*a* and 51*a*, which are near the central expanding ejection port 3, of the side expanding ejection ports 41 and 51 satisfy a relationship of $-5° \leq \beta in$. At the same time, the expanding angle α of the central expanding ejection port 3 and an angle βout formed by outer side walls 41*b* and 51*b*, which are far from the central expanding ejection port 3, of a pair of the side expanding ejection ports 41 and 51 satisfy a relationship of $\beta out \leq \alpha + 15°$. In this way, βin and βout are set as described above.

Similarly to the burner 1 according to the first embodiment, the angles βin and βout are measured with respect to the inner wall 41*a* or the outer wall 41*b* of the side expanding ejection port 41 in the counterclockwise direction as positive, and the clockwise direction as negative.

In other words, in FIG. 7, the angle βin is expressed by a negative angle measured in the clockwise direction with reference to the side expanding wall 41*a*, and the angle βout is expressed by a positive angle measured in the counterclockwise direction with reference to the side expanding wall 41*b*.

In the burner 1 according to the first embodiment described above, when the angle β between the ejection ports 5 and 7 provided on both sides of the central expanding ejection port 3 is −5° or more, it is possible to increase the swing width in self-oscillating of the main combustion fluid (fuel fluid) ejected from the central expanding ejection port 3.

On the other hand, in the burner 31 according to the second embodiment, when both the main combustion fluid (fuel fluid) which is ejected from the central expanding ejection port 3 and the second combustion fluid (combustion-assisting fluid) which is ejected from the side expanding ejection ports 41 and 51 self-oscillate without a phase difference, the angle βin formed by inner side walls 41*a* and 51*a* of the side expanding ejection ports 41 and 51 may be set to less than −5°.

When there is a phase difference in the self-oscillating of the main combustion fluid and the self-oscillating of the second combustion fluid, the jet flow of the main combustion fluid and the jet flow of the second combustion fluid intersect and the self-oscillating of the flame is restricted, and the heating surface area due to heat radiation from flame decreases.

Therefore, when the angle βin formed by the inner walls 41*a* and 51*a* of the side expanding ejection ports 41 and 51 is set to less than −5°, it is important to match the phases in the self-oscillating of the main combustion fluid and the second combustion fluid.

However, it is not always easy to match the phases in the self-oscillating of the main combustion fluid and the second combustion fluid, and there is a case in which while the phase difference occurs, the main combustion fluid and the second combustion fluid are ejected while self-oscillating.

Even when the main combustion fluid and the second combustion fluid are ejected while self-oscillating in a case of generating the phase difference, it is possible to form a flame self-oscillating without narrowly restricting the swing width of the main combustion fluid by the second combustion fluid similar to the burner 1 according to the first embodiment by setting the angle βin formed by the inner walls 41*a* and 51*a* of the side expanding ejection ports 41 and 51 to −5° or more.

As described above, according to the burner 31 according to the second embodiment, it is possible to effectively mix and combust the fuel fluid which is ejected while self-oscillating from the central expanding ejection port 3 and the combustion-assisting fluid which is ejected while self-oscillating from the side expanding ejection port 41 or 51. Accordingly, the flame can be formed in a wide area while improving the combustion efficiency and the heat radiation can be further enhanced.

Example 1

Specific experiments were conducted to confirm the effects of the burner according to the present invention, and the results will be described below.

In Example 1, a flame self-oscillating was formed using the burner 1 shown in FIG. 1. A plurality of the burners 1, in which the expanding angle α of the central expanding ejection port 3 was set to 60° and the angle β formed by the central axis Ca of one side ejection port 5 and the central axis Cb of the other side ejection port 7 was changed, were prepared. The effects of angle β on heat radiation from the flame were confirmed using a plurality of the burners 1.

In Example 1, LP gas was used as the main combustion fluid and an oxygen-enriched air containing 40% by volume of oxygen was used as the second combustion fluid. LP gas was supplied at 8 $Nm^3/h$ to the central expanding ejection port 3 through the main combustion fluid supply passage 9. The oxygen-enriched air was supplied at 105 $Nm^3/h$ to the side ejection ports 5 and 7 through the second combustion fluid supply passages 17 and 19. LP gas was burned at an oxygen ratio of 1.05.

Here, the oxygen ratio is a value which indicates how many times oxygen with respect to the stoichiometric ratio has been supplied to a certain amount of fuel. For example, the oxygen ratio of 1.05 indicates a state in which oxygen is supplied slightly excess (1.05 times) than the theoretical amount of oxygen to completely combust the fuel.

In the experiments, a heat transfer measurement board (not shown) was installed at a position 600 mm from the tip end of the burner 1, the expanding angle α was fixed at 60°, the angle β was set to −10°, −5°, 0°, 60°, 75°, and 90°, the heat radiation amount of the flame formed at each angle β was evaluated by the heat transfer amount to the cooling water flowing through the heat transfer measurement board.

The heat transfer measurement board includes a plurality of micro-width water cooling pipes for flowing cooling water which are connected. The heat transfer measurement board can measure the inlet temperature and the outlet temperature of the cooling water in each water cooling pipe and the flow amount of the cooling water.

In Example 1, as described above, LP gas and the oxygen-enriched air were supplied to the burner 1 to ignite the burner 1, the flame self-oscillating was applied to the heat transfer measurement board. The heat transfer amount in each water cooling pipe was calculated based on the temperature difference between the outlet and the inlet of the cooling water and the flow rate of the cooling water in the heat transfer measurement board.

Figure 8:
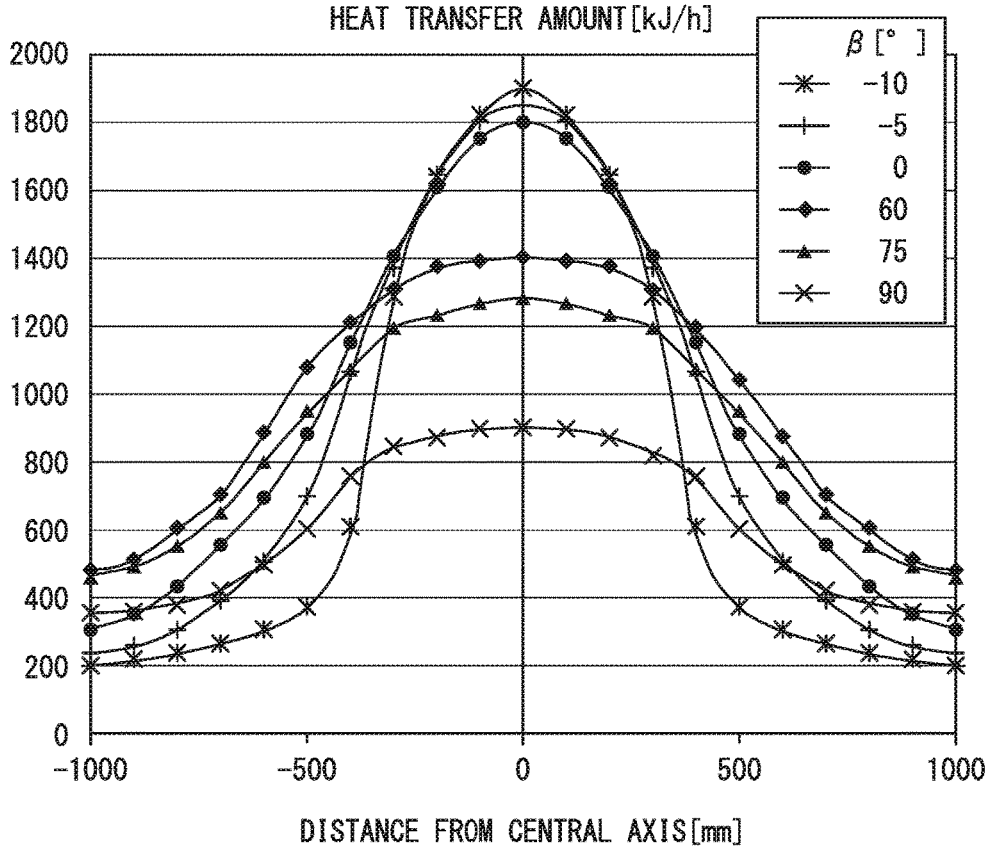
FIG. 8 is a graph for showing measurement results of a heat transfer amount in Example 1.

The measurement results of the heat transfer amount at each angle β are shown in FIG. 8. In FIG. 8, the horizontal axis represents the distance [mm] from the central axis of the burner 1 at a position 600 mm away from the tip end of the burner 1, and the vertical axis represents the heat transfer amount [kJ/h] to the cooling water measured at each point of the heat transfer measurement board.

In the case of β=60° and 75°, it was understood that the heat radiation was generated over a wider area than in a case of other angles. However, in the case of β=90°, the heat transfer amount to the heat transfer measurement board was decreased. This is presumed to be caused by the fact that the oxygen-enriched air was ejected to the outside of the swing width of the LP gas self-oscillating, so that the LP gas ejected from the central expanding ejection port 3 and the oxygen-enriched air were not sufficiently mixed.

On the other hand, when β≤0, the extension of the flame was suppressed, and the area of heat radiation was close to the central axis.

In the case of β=0 and −5°, there was some extension in the area of heat radiation. However, in a case of β=−10°, the heat radiation is limited to a narrow area and it could be understood that a wide area of the heat radiation was hardly obtained by self-oscillating.

From the above, it was confirmed that it was possible to radiate heat in a wide area by self-oscillating without lowering the total heat transfer amount when the angle β of the side ejection ports 5 and 7 was set to −5°≤β≤α+15°.

Example 2

In Example 2, a flame self-oscillating was formed using the burner 1 shown in FIG. 1, fixing the expanding angle α of the central expanding ejection port 3 to 45°, and changing the angle β formed by the central axes of a pair of the side ejection ports 5 and 7 to −10°, −5°, 0°, 45°, 60° and 75°, and the heat transfer amount from the flame was measured in the same manner as in Example 1.

As in the case of the first embodiment, LP gas was supplied at 8 $Nm^3/h$ as the main combustion fluid to the central expanding ejection port 3 through the main combustion fluid supply passage 9. The oxygen-enriched air containing 40% by volume of oxygen was supplied at 105 $Nm^3/h$ to the side ejection ports 5 and 7 through the second combustion fluid supply passages 17 and 19. The LP gas was burned at an oxygen ratio of 1.05.

As a result of the experiments, in the burner 1 in which β was set to −10°, −5°, or 0°, the same results as in Example 1 in which the expanding angle α of the central expanding ejection port 3 was set to 60° were obtained. That is, when β was set to −5θ or 0°, a good flame having an extended area of heat radiation was formed. However, when β=−10°, the area of heat radiation was limited to be narrow.

In burner 1 in which β was set to 45° or 60° (≤α+15°), good heat radiation in a wide area was obtained from the flame. However, when β was set to 75°, as in the case in which β was set to 90° in Example 1, the total heat transfer amount to the heat transfer measurement board was greatly decreased.

As described above, even when the expanding angle α of the central expanding ejection port 3 was 45°, it was possible to radiate heat an extended area by self-oscillating without decrease of the total heat transfer amount by setting the angle β of the pair of the side ejection ports 5 and 7 to −5°≤β≤α+15°.

Example 3

In the Example 3, a flame self-oscillating was formed using the burner 1 shown in FIGS. 1 and 2, fixing the expanding angle of the central expanding ejection port 3 to 90° (α=90°), and changing the angle β formed by the central axes of the side ejection ports 5 and 7 in a range of −10° to 120°, and the heat transfer amount from the flame was measured in the same manner as in Examples 1 and 2 described above.

Here, the shape of the burner 1 other than the angle β was the same as that of the Examples 1 and 2, and the combustion conditions were the same as those of Examples 1 and 2.

In the burner 1 in which the angle β was set in a range of −5° to 0°, the area of the heat radiation from the flame had some extension and good heat radiation was obtained. However, in the burner 1 in which the angle β was set to −10°, the heat radiation reached was limited to a narrow area.

On the other hand, in the burner 1 in which the angle β was set to 105° or less β≤105° (=α+15°), satisfactory heat radiation can be obtained over a wide area from the flame. However, in the burner 1 in which the angle β was set to more than 105° (β>105°), the total heat transfer amount to the heat transfer measurement board was largely reduced.

Figure 9:
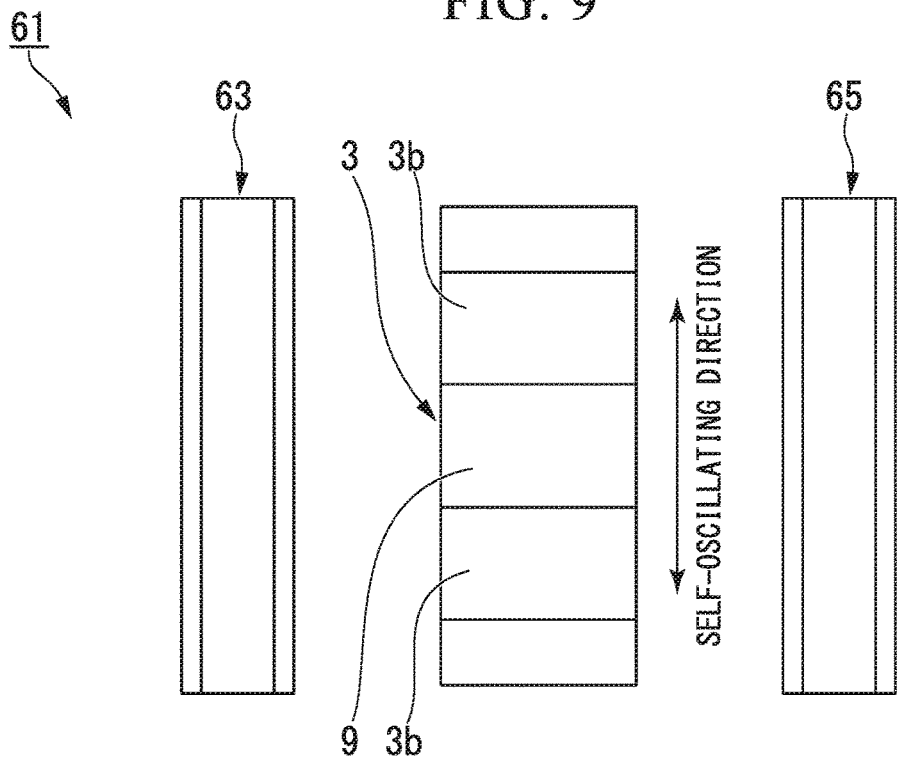
FIG. 9 is a view for explaining a burner used as a comparative example of Example 3.

Further, in Example 3, as a Comparative Example, heat radiant from flame was measured using a burner 61 in which a pair of ejection ports 63 and 65 was provided in a direction orthogonal to the expanding direction (self-oscillating direction) of the central expanding ejection port 3 with expanding angle α=90° (See FIG. 9) and the heat transfer measurement board installed in front of the burner 61. In the Comparative Example, LP gas was supplied to the central expanding ejection port 3 and the oxygen-enriched air was ejected as the second combustion fluid from the ejection ports 63 and 65 as in Examples 1 and 2. The supply amount of the LP gas and the oxygen-enriched air and the oxygen ratio (=1.05) were respectively the same as those in Examples 1 and 2.

Figure 10:
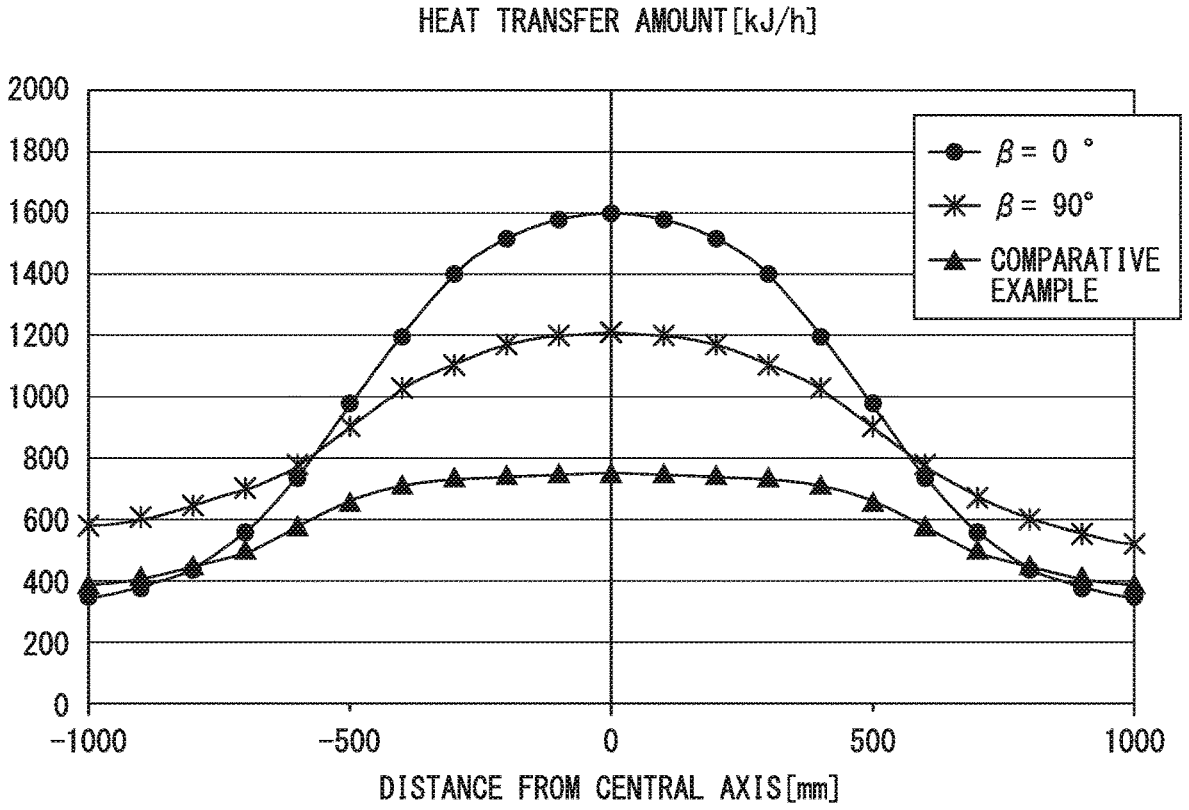
FIG. 10 is a graph for showing measurement results of a heat transfer amount in Example 3.

FIG. 10 shows the measurement results of the heat transfer amount in the burner 1 in which the angle β was set to 0° and 90° (β=0° and 90°) in the Example 3 and the heat transfer amount in the burner 61 according to the Comparative Example.

In the burner 61 of the Comparative Example, since the expanding angle α of the central expanding ejection port 3 was large (α=90°), it was observed that the swing width of the flame became large. As shown in FIG. 10, compared with the results of the Examples 1 and 2, the total heat transfer amount was reduced, and the heat radiation was not performed effectively.

On the other hand, in the burner 1 in which the side ejection ports 5 and 7 were provided in the expanding direction of the central expanding ejection port 3 (β=0° and 90°), even when the expanding angle α of the central expanding ejection port 3 was set to 90° (α=90°), the total heat transfer amount was not decreased (see FIG. 10), compared with the Comparative Example. In addition, it was confirmed that the area of heat radiation and the heat transfer amount could be appropriately adjusted by adjusting the angle β formed by the side ejection ports 5 and 7.

As described above, it was confirmed that even when the expanding angle α of the central expanding ejection port 3 was set to 90°, it was possible to radiate heat to a wide area without a decrease of the total heat transfer amount rate by self-oscillating when setting the angle 1 formed by the side ejection ports 5 and 7 within a range of $-5° \leq \beta \leq \alpha + 15°$.

Example 4

In the Example 4, a flame self-oscillating was formed using a burner 21 as shown in FIG. 5, in which the side ejection ports 5 and 7 were provided on both sides of the expanding direction of the central expanding ejection port 3, and the second ejection ports 23 and 25 were provided in a direction orthogonal to the expanding direction, and the heat transfer amount from the flame was measured.

In the Example 4, the expanding angle α of the central expanding ejection port 3 was set to 600, the angle β between the side ejection ports 5 and 7 was set to 60°, and the angle γ formed by the central axes of the second ejection ports 23 and 25 was set to 0°.

Experiments were conducted by supplying LP gas at 8 $Nm^3/h$ as the main combustion fluid to the central expanding ejection port 3, and the oxygen-enriched air containing 40% by volume of oxygen at 105 $Nm^3/h$ as the second combustion fluid to the side ejection ports 5 and 7, and the second ejection ports 23 and 25.

Figure 11:
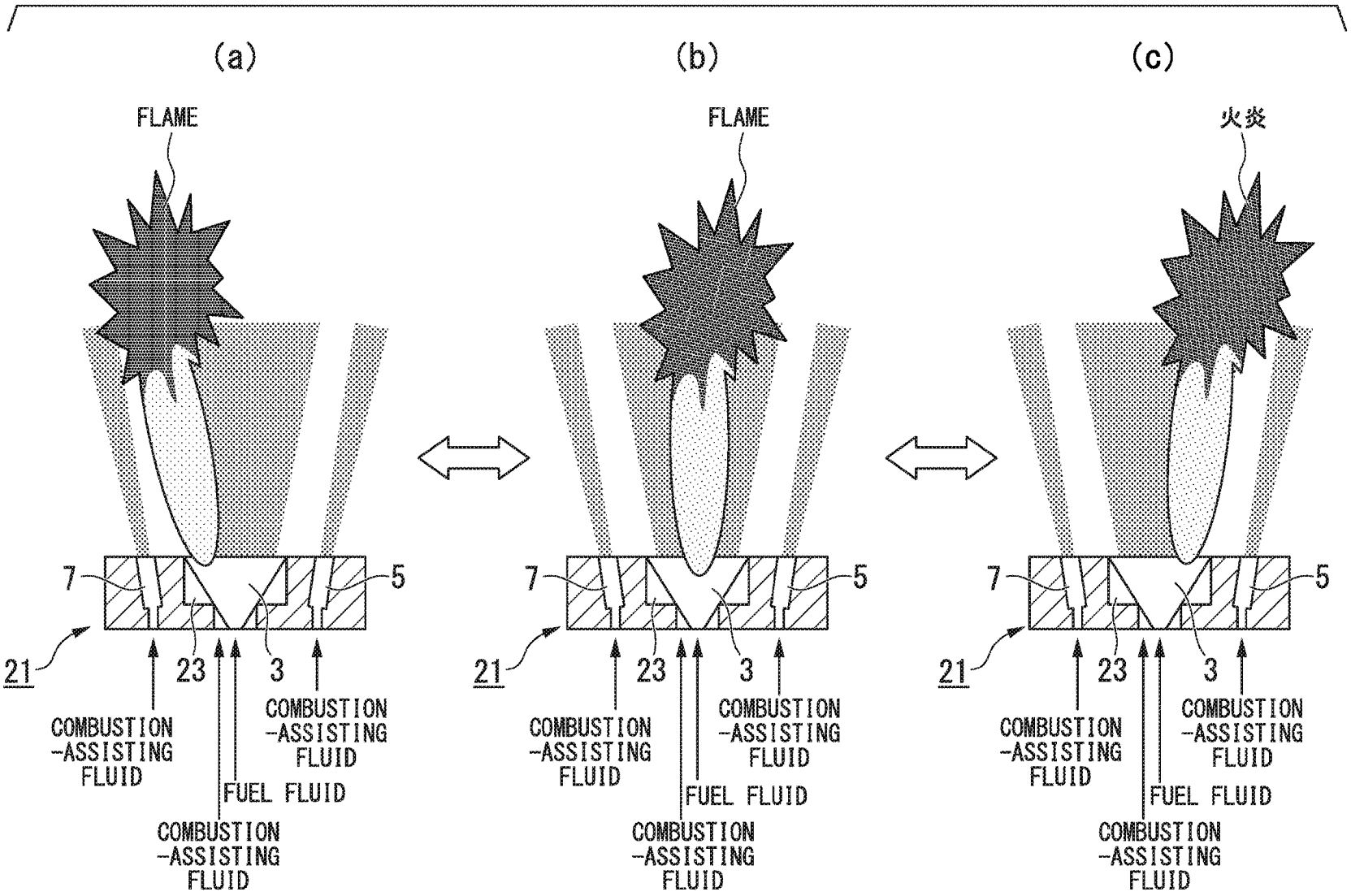
FIG. 11 is a view for explaining behavior of a flame self-oscillating in the burner used in Example 3.

Here, the oxygen-enriched air was distributed such that the flow ratio supplied to the side ejection ports 5 and 7 and the second ejection ports 23 and 25 was 6:4. The flow rate of the oxygen-enriched air ejected from the side ejection ports 5 and 7 was set to 100 m/s. The flow rate of the oxygen-enriched air ejected from the second ejection ports 23 and 25 was set to 40 m/s. The oxygen-enriched air ejected from the burner 21 as shown in FIG. 11.

As a result of the combustion experiments, it was confirmed that the combustion efficiency was improved and the heat transfer from the flame was further improved by using the burner 21 in which the second ejection ports 23 and 25 were provided in the vertical direction of the central expanding ejection port 3.

In the Example 4, the angle γ between the second ejection ports 23 and 25 was set to 0°, but the angle γ is not limited thereto.

Example 5

In the Example 5, a flame self-oscillating was formed using a burner 31 as shown in FIGS. 6 and 7, in which the side expanding ejection ports 41 and 51 were provided on both sides of the central expanding ejection port 3, and the heat transfer amount from the flame was measured.

Experiments were conducted by supplying LP gas at 8 $Nm^3/h$ as the main combustion fluid to the central expanding ejection port 3, and the oxygen-enriched air containing 40% by volume of oxygen at 105 $Nm^3/h$ as the second combustion fluid to the side expanding ejection ports 41 and 51.

Then, the heat transfer amount was measured by the heat transfer measurement board (not shown) which was installed at a position 600 mm from the tip end of the burner 31.

In the burner 31 used in Example 5, the expanding angle α of the central expanding ejection port 3 was set to 60°, the angle βin formed by the inner side wall 41*a* of the side expanding ejection port 41 and the inner side wall 51*a* of the side expanding ejection port 51 was set to 0°, and the angle βout formed by the outer side wall 41*b* of the side expanding ejection port 41 and the outer side wall 51*b* of the side expanding ejection port 51 was set to 60°.

Furthermore, the experiment was carried out such that the self-oscillating of the fuel fluid ejected from the central expanding ejection port 3 and the self-oscillating of the oxygen-enriched air ejected from the side expanding ejection ports 41 and 51 do not have a phase difference (that is, the fuel fluid and the oxygen-enriched air swung in the right and left at the same timing).

Figure 12:
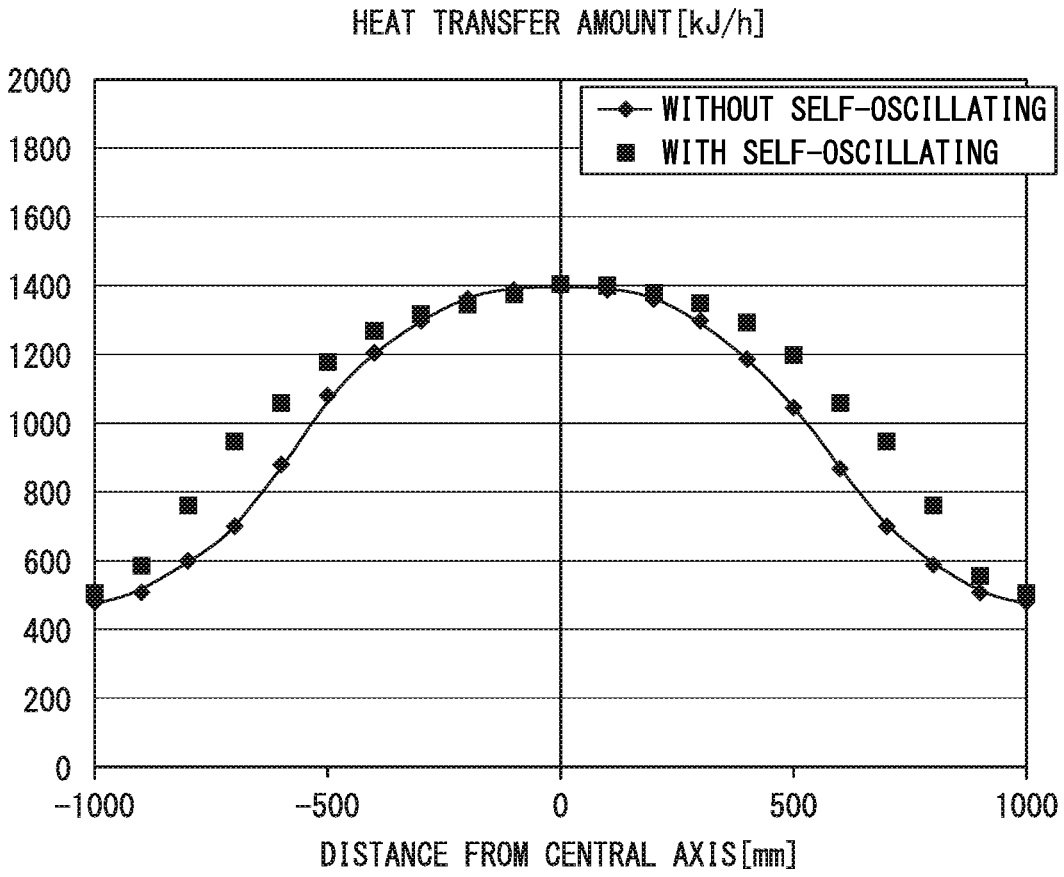
FIG. 12 is a graph for showing measurement results of a heat transfer amount in Example 5.

FIG. 12 shows the measurement results of the heat transfer amount. FIG. 12 also shows the measurement results in a case in which the burner 1 shown in FIG. 1 was used, and the oxygen-enriched air was ejected from the side ejection ports 5 and 7 without self-oscillating (that is, β=60° in Example 1) for comparison.

It was confirmed from FIG. 12 that the area of heat radiation was extended, and the total heat transfer amount was also increased in the case of using the burner 31. It was thought that the results were obtained by self-oscillating the oxygen-enriched air ejected from the side expanding ejection ports 41 and 51, the fuel and the oxygen-enriched air in the self-oscillating direction were well mixed to improve the combustibility.

From these results, it was confirmed that the area of heat radiation was extended, and the total heat transfer amount was also increased by ejecting the fuel fluid from the central expanding ejection port and the oxygen-enriched air from both side of the central expanding ejection port while self-oscillating.

INDUSTRIAL APPLICABILITY

The burner of the present invention can increase the combustion efficiency by mixing the main combustion fluid and the second combustion fluid well even in the case in which the swing width of the flame self-oscillating is large, thereby increasing the heat radiation while forming the flame in a wide area.

EXPLANATION OF REFERENCE NUMERAL

1 burner
3 central expanding ejection port
3*a* and 3*b* expanding wall
5 and 7 side ejection port
9 main combustion fluid supply passage
9*a* side wall
11 duct opening portion
13 straight body portion
15 communication duct
17 and 19 second combustion fluid supply passage
21 burner
23 and 25 second ejection port
31 burner
41 and 51 side expanding ejection port
41*a* and 51*a* side expanding wall (inside wall)
41*b* and 51*b* side portion expanding wall (outer wall)
43 and 53 second combustion fluid supply passage
45 and 55 duct opening portion
47 and 57 straight body portion
49 and 59 communication duct
61 burner (comparative example)
63 and 65 ejection port (comparative example)

The invention claimed is:

1. A burner in which a main combustion fluid and a second combustion fluid are combusted by ejecting the main combustion fluid while self-oscillating from a central expanding ejection port which expands towards a tip end and ejecting the second combustion fluid which forms a flame together with the main combustion fluid from a pair of side ejection ports provided on both sides of the central expanding ejection port in a self-oscillating direction, wherein a pair of the side ejection ports have a rectangular tubular shape, from which the second combustion fluid is ejected without self-oscillating, and are disposed symmetrically with respect to a central axis of the central expanding ejection port, and the central expanding ejection port and the side ejection ports are provided such that an expanding angle $\alpha$ of the central expanding ejection port and an angle $\beta$ formed by the central axes of a pair of the side ejection ports satisfy a relationship of $-5° \leq \beta \leq \alpha + 15°$.

* * * * *